US007083845B2

(12) United States Patent
Graff

(10) Patent No.: US 7,083,845 B2
(45) Date of Patent: Aug. 1, 2006

(54) SHEET OF ABSORBENT CREPED PAPER, CYLINDER FOR EMBOSSING SUCH A SHEET AND AN EMBOSSING PROCESS

(75) Inventor: Pierre Graff, Wolfgantzen (FR)

(73) Assignee: Georgia-Pacific France, Kunheim (FR)

( * ) Notice: Subject to any disclaimer, the term of this patent is extended or adjusted under 35 U.S.C. 154(b) by 0 days.

(21) Appl. No.: 10/258,232

(22) PCT Filed: Feb. 22, 2002

(86) PCT No.: PCT/FR02/00673

§ 371 (c)(1),
(2), (4) Date: Nov. 12, 2002

(87) PCT Pub. No.: WO02/068758

PCT Pub. Date: Sep. 6, 2002

(65) Prior Publication Data

US 2003/0118782 A1 Jun. 26, 2003

(30) Foreign Application Priority Data

Feb. 23, 2001 (EP) ..... 01400477

(51) Int. Cl.
*D21H 27/40* (2006.01)
*B31F 1/07* (2006.01)

(52) U.S. Cl. ..... 428/166; 428/156; 428/167; 428/172; 162/109

(58) Field of Classification Search ..... 428/156, 428/166, 167, 172; D5/53; 162/109, 111, 162/113, 116, 117
See application file for complete search history.

(56) References Cited

U.S. PATENT DOCUMENTS

| | | | | |
|---|---|---|---|---|
| 3,414,459 | A | 12/1968 | Wells | 161/131 |
| 3,738,905 | A * | 6/1973 | Thomas | 428/154 |
| 3,867,225 | A | 2/1975 | Nystrand | 156/209 |
| 4,320,162 | A | 3/1982 | Schulz | 428/154 |
| 5,173,351 | A | 12/1992 | Ruppel et al. | 428/1.74 |
| 5,382,464 | A | 1/1995 | Ruppel et al. | 428/172 |
| 5,736,223 | A | 4/1998 | Laurent | 428/154 |
| 5,830,558 | A | 11/1998 | Barnholtz | 428/171 |
| 6,032,712 | A | 3/2000 | Biagiotti | 156/358 |
| 6,109,326 | A | 8/2000 | Leakey et al. | 156/553 |
| 6,277,466 | B1 * | 8/2001 | McNeil et al. | 428/154 |
| 6,287,676 | B1 * | 9/2001 | Ruppel et al. | 428/219 |
| 6,524,683 | B1 * | 2/2003 | Roussel et al. | 428/172 |

FOREIGN PATENT DOCUMENTS

| | | | |
|---|---|---|---|
| EP | 1 081 284 A1 | | 3/2001 |
| WO | WO 93/12293 | * | 6/1993 |
| WO | WO 99/36253 | * | 7/1999 |

* cited by examiner

*Primary Examiner*—Alicia Chevalier
(74) *Attorney, Agent, or Firm*—Breiner & Breiner, L.L.C.

(57) ABSTRACT

The invention relates to an embossed sheet 10 made up of at least a first and a second ply 12, 14 of creped cellulose cotton of the type in which the first ply 12 has an embossed design 16 involving a first series of first projections 18 that form in particular first alignments and in which the apexes 32 are connected to the internal face 24 of the facing second ply 14 characterized in that these two plies 12, 14 each have a second embossed design 36 involving a second series of second projections 38, 40, and by the fact that the apexes 42, 44 of the second projections 38, 40 of a ply 12, 14 extended outward and are facing and near apexes 44, 42 of the second projections 40, 38 of the other ply 14, 12.

7 Claims, 4 Drawing Sheets

SHEET OF ABSORBENT CREPED PAPER, CYLINDER FOR EMBOSSING SUCH A SHEET AND AN EMBOSSING PROCESS

FIELD OF THE INVENTION

The invention relates to a sheet of paper, in particular a sheet of absorbent paper of creped tissue having an embossed design pattern.

The invention relates particularly to a sheet of paper made up in particular of at least a first ply and a second ply of creped absorbent tissue paper intended for the area of application of wiping in household, domestic, and industrial use, that is, can be utilized as an all-purpose wipe, rag, etc.

BACKGROUND OF THE INVENTION

In the area of application of paper for sanitary or domestic use, such as toilet paper or all-purpose wipes, the production of sheets of paper made up of several plies of absorbent paper, such as of tissue paper, with a square meter surface measure weight ranging from 12 to 30 g/m$^2$ provided with projections which are obtained by embossing, is a known technique.

Embossing in fact imparts bulk to the sheet and leads to improvement in absorption of liquids, feel, and softness. An attempt has been made to increase the absorptivity further by creating multilayer sheets obtained by combining two layers, also called plies, each made up of at least one of such embossed sheets.

Thus, a multilayer sheet is obtained that has mechanical characteristics such as specific resistance to traction as well as a specific absorptivity.

Two methods of embossing and assembly of such plies are currently applied, depending on the characteristics desired for the final product.

The first is known in this particular field under the designation of the "nested" design method. It consists first of embossing each of the plies separately so as to form on the surface projections which are generally substantially tapered in shape or are shaped as truncated pyramids. Adhesive is then applied to the top or apex of the projections of one of the plies, and the plies are arranged so that the surfaces present facing the projections, with the projections of one surface being opposite the projections of the other surface. Lastly, the plies are assembled so that the projections which have been glued nest within the projections of the other ply. Thus the two plies are connected by adhesive points between the tops of the projections of one ply and the non-embossed zones between the projections of the other ply. A structure is thus created, the voids of which made in this manner are suitable to ensure improved absorption for the sheet. In addition, the outer surfaces have a smooth and soft feel due to the hollow areas formed by the back of the projections. This technique is shown in U.S. Pat. No. 3,867,225.

The second assembly method is known in this field as "tip-to-tip" assembly. It differs from the preceding method in the relative arrangement of the two plies. After the latter have been separately embossed, they are placed one on top of the other so that the apexes of the projections coincide or so that at least a portion of the apexes coincide. The plies are connected to each other by the tops of the projections, tip to tip. This technique is shown in U.S. Pat. No. 3,414,459.

When the practical embodiments of these structures, whether of the nested or tip-to-tip type, are examined, it is found that the projections obtained during embossing are most often produced in such a way as to be distributed according to a pattern in which the projections are generally aligned uniformly according to one or several directions. One such design permits a homogenous sheet relative to its mechanical characteristics to be obtained.

However, in order to improve user satisfaction, it is important to increase the suppleness of the sheet.

The suppleness of the sheet can be defined as being its capacity to be deformed regularly when it is placed in the hand of a user, his fingers being stretched out in an extension of his palm and when the user then pulls back his fingers.

A sheet of paper which presents a high degree of suppleness is then going to be deformed and be curved or cambered in such a way as to remain more or less parallel to the form determined by the interior of the palm of the hand of the user.

A sheet of paper which presents a low degree of suppleness will be folded along one or several lines, each part of the sheet that extends itself between two folding lines remaining more or less flat.

A sheet of paper which has a high degree of suppleness is more convenient to use.

Generally speaking, an increase in suppleness of the sheet causes in particular a decrease in its mechanical characteristics.

BRIEF SUMMARY OF THE INVENTION

An object of the invention is to propose a new design of an embossed sheet that will allow the suppleness of the sheet to be increased without diminishing its mechanical characteristics.

To accomplish this object, the invention provides an embossed sheet composed of at least one first and one second ply of creped tissue with a square meter surface measure weight ranging from 12 to 30 g/m$^2$ of the type in which at least a first ply has a first embossed design pattern comprised of a first series of first projections, generally tapered in shape and extending above the internal face of the first ply, which form in particular first alignments and in which the apexes are connected to the internal face of the second ply, characterized by the fact that these two plies each have a second design pattern comprising a second series of second projections extending above the internal face of a corresponding ply and by the fact that the apexes of the second projections of the ply extend outward and are facing and near the apexes of the second projections of the other ply.

Other features of the invention are that:

the apexes of the second projections of a ply are in contact with the apexes of the second projections facing the other ply;

the apexes in contact with the second projections are not connected;

the heights of the second projections of the two plies are substantially-equal;

each of the second plies has a first series of the first projections, generally tapered in shape and extending over the internal face of the ply, which form the first alignments;

the aligned projections of the first series form figures of a shape of a closed loop;

each of the two plies have a first series of first projections and an associated series of first projections, and the associated series of the first projections of the one and of the other ply are nested between the associated series of projections of the other of the two plies;

the second projections have dotted apexes;

the second projections have linear apexes.

The invention also provides a pair of engraved cylinders for embossing an embossed sheet as specified in any one of the succeeding claims in which at least one of the cylinders comprises a first series of first picots generally tapered in shape and forming the first alignments characterized by the fact that the two engraved cylinders each have a second series of second picots in relief, dotted, and/or linear in which each second picot of a cylinder corresponds substantially with a second picot of the other cylinder and in which the sum of the heights of the corresponding second picots is substantially equal to the height of the first picots.

Lastly, the invention provides a process for manufacturing an embossed sheet by means of a pair of cylinders according to succeeding claims, characterized by the fact that it involves embossing the two plies in such a way as to form the first and the second embossed design pattern, then assembling the two plies so that the apexes of the first projections are linked to the internal face of the facing ply and so that the apexes of the second projections of a ply extend outward and are facing and near the apexes of the second projections of the other ply.

BRIEF DESCRIPTION OF THE DRAWINGS

Further features and advantages of the invention will become apparent in reading the following detailed description, the understanding of which will be facilitated by the attached drawings, wherein.

DETAILED DESCRIPTION OF THE INVENTION

Figure 1:
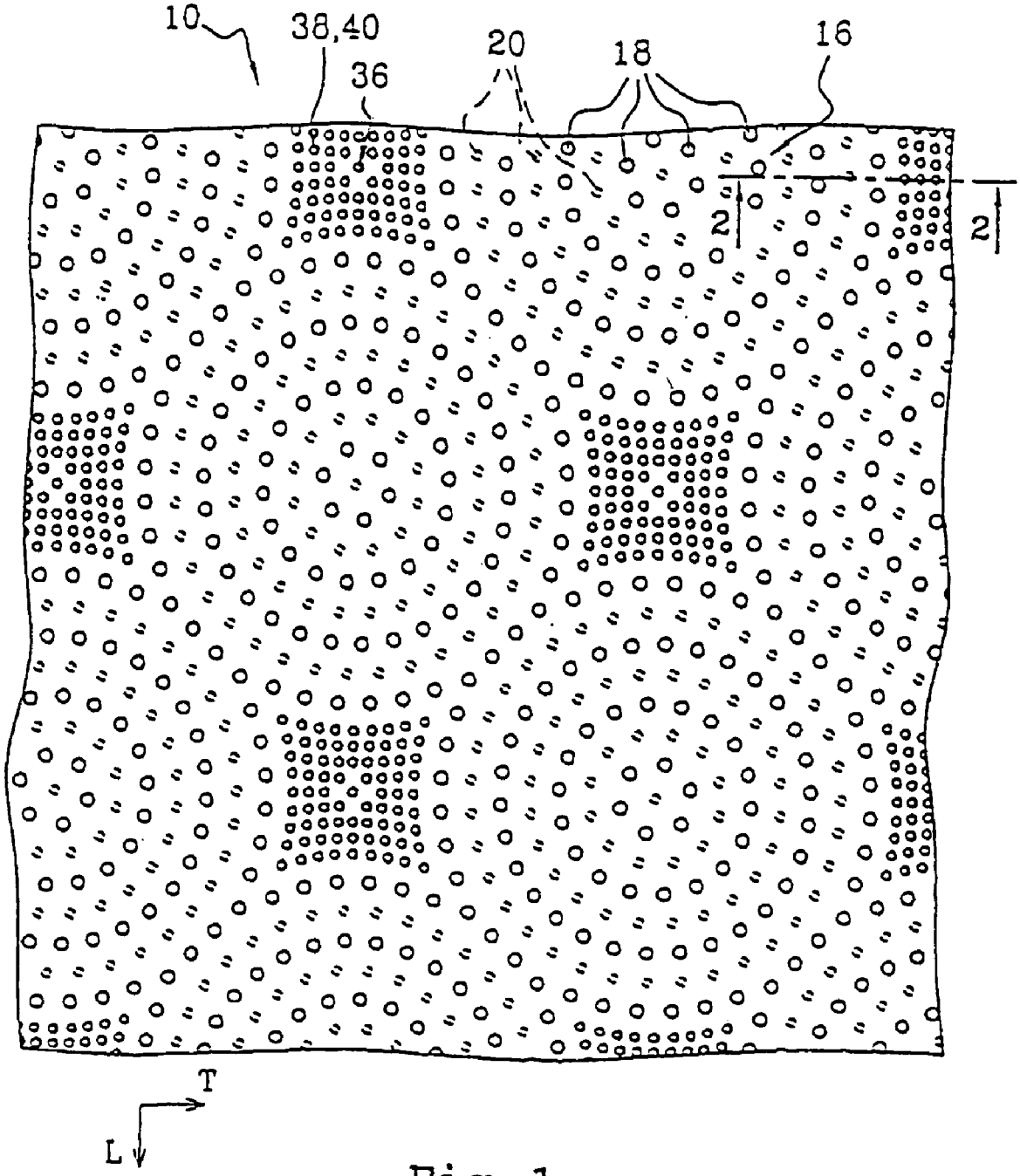
FIG. 1 illustrates as viewed from above an embodiment example of a sheet of paper embossed in accordance with the teaching of the invention and more particularly a kitchen towel sheet.
Figure 2:
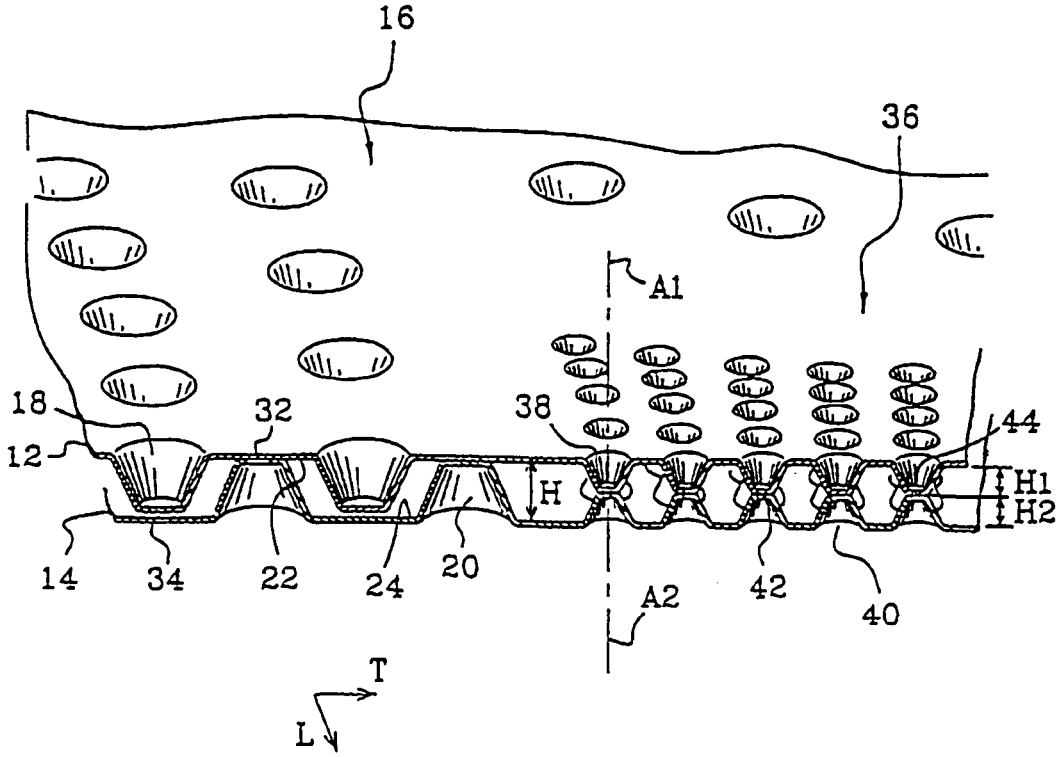
FIG. 2 is a diagrammatic cross-section and perspective view of a sheet of embossed paper made in accordance with the teaching of the invention.

An example of the embodiment of a sheet 10 of embossed paper is shown in FIGS. 1 and 2, particularly a sheet comprised of a first upper ply 12 and of a second lower ply 14 of absorbent paper, of creped tissue, intended for all types of hygienic or household products.

The tissue paper, with a surface measure ranging from 12 to 30 g/m$^2$, is of the type obtained by Conventional Wet Pressing (CWP) or of the type obtained by Transverse Air Drying (TAD).

More particularly, the sheet of paper 10 shown in FIGS. 1 and 2 is, for example, intended for incorporation into a roll of a kitchen towel paper.

The sheet 10 is oriented along two longitudinal and transverse directions, shown in FIG. 2 by arrows L and T, which correspond to the direction of progression of the sheet 10 during its manufacture, also called the direction of "advance" and in the perpendicular direction respectively, also called the "transverse" direction.

After embossing, a first design pattern 16 is apparent and is visually detached from the first ply 12 and from the second ply 14 of the sheet 10.

The first embossed design pattern 16 of each ply 12 and 14, of generally known design, is comprised of a first series of first projections 18 and 20, generally tapered in shape and extending above the internal face 22, 24 of the corresponding ply 12, 14 while also extending over the interior of the sheet 10.

The first projections 18 and 20 form in particular the first alignments according to the drawings, in particular as closed loops which are seen here as circles.

Here, in accordance with FIG. 1, the associated series of the first projections 18, 20, of the one and of the other ply 12, 14 are nested, concentrically, between the associated series of the projections 20, 18 of the other 14, 12 of the two plies.

The first series of first projections 18 and 20 are aligned according to two principal directions in such a way as to define a ruled square quad. The two principal directions here are perpendicular between them and are inclined at 45 degrees relative to the longitudinal L and transverse T directions of the sheet 10.

The apexes 32, 34 of the first projections 18, 20 are connected to the internal face 24, 22 of the facing ply 14, 12 (see FIG. 2).

Figure 6:
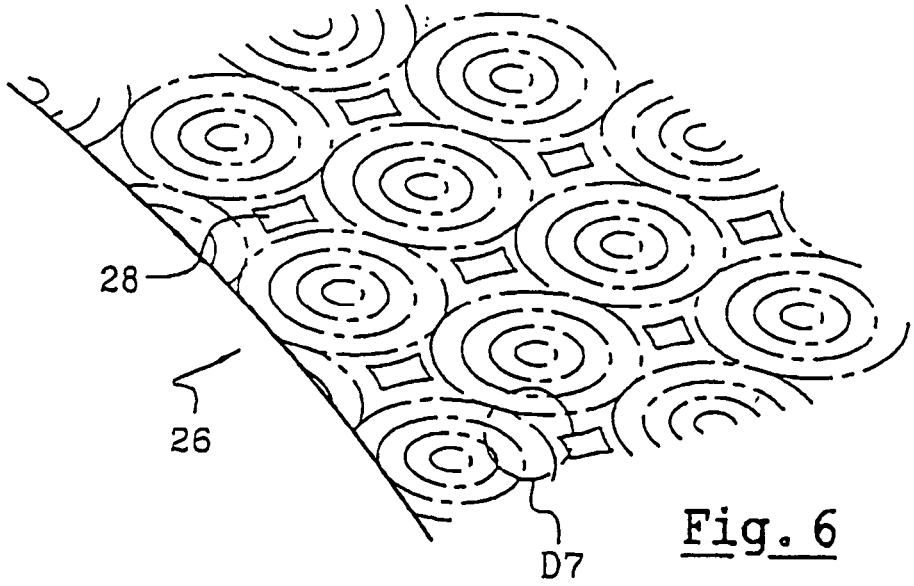
FIG. 6 is a perspective diagrammatic view illustrating the convex cylindrical surface of an embossing cylinder of a ply of a sheet according to FIG. 1.
Figure 7:
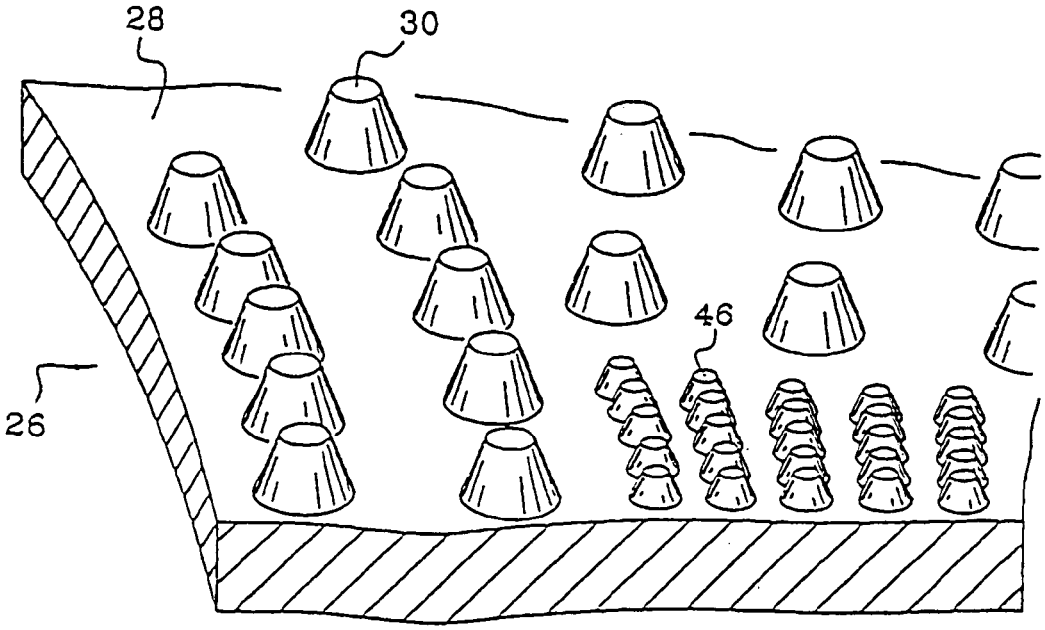
FIG. 7 is a enlarged view of detail D7 of FIG. 6.

According to a known technique, the first projections. 18, 20 comprising the elements of the first design pattern 16 are obtained by embossing the first ply 12 and the second ply 14 of the sheet 10 by means of a pair of cylinders, one of which is shown in FIGS. 6 and 7 as cylinder 26.

The homologous "projections" of those sought to be obtained on the first ply 12 and the second ply 14 of the sheet 10 are formed in relief on the convex cylindrical external face 28 of the associated cylinder 26.

For making the series of first projections 18 on the first ply 12 of the sheet 10, the embossing cylinder 26 has on its convex cylindrical face 28 a first homologous series of picots in relief 30 generally tapered in relief, which are arranged in concentric circles along the first alignments of the first projections 18, in such a way as to make the corresponding part of the first design pattern 16 of the first ply 12.

Similarly, the series of first projections 20 on the second ply 14 of the sheet 10 is made by another analogous embossing cylinder in which the picots in relief are arranged as concentric circles along the first alignments of first projections 20, in such a way as to make the corresponding part of the first design pattern 16 of the second ply 14.

When the first ply 12 and the second ply 14 are embossed, they are assembled among themselves by gluing the apexes 32 or 34 of the first projections 18 or 20 on the internal face 24 or 22 of the second ply 14 or the facing first ply 12.

In accordance with the teaching of the invention, and in order to improve the suppleness of the sheet 10 without diminishing its mechanical characteristics and its absorption capacity, the two plies 12, 14 have a second embossed design pattern 36 involving a second series of second projections 38, 40 which are, for example, generally tapered, i.e., with dotted apexes, extending out above the corresponding internal face 22, 24 of ply 12, 14, while thus extending over the interior of the sheet 10.

The axes A1 and A2 of the second projections 38 and 40 of the first ply 12 and of the second ply 14 are more or less aligned.

The second projections 38 and 40 are made similar to the first projections 18 and 20, in particular by a second series of second picots 46 tapered in shape which extend to the convex surface 28 of the embossing cylinder 26.

Each second picot of a cylinder corresponds preferably with a corresponding second picot of the other cylinder, and the sum of the heights of the corresponding second picots is substantially equal to the height of the first picots.

The second projections 38, 40 form in particular the second alignments according to the figures, in particularly as closed loops, which are arranged between the first series of first projections 18 and 20.

Here the closed loops have the general form of a square whose sides are curved inward and concave in a manner substantially parallel to the circles defined by the first projections 18 and 20.

However, the second alignments may be of other forms, geometric or not, such as those of diamonds or flowers.

It is also possible that the second alignments of the second projections 38 and 40 have circles that are concentrically arranged in the circles of the first series of the first projections 18 and 20.

As a variant not shown in the drawings !the second projections are not necessarily tapered projections with dotted apexes, but they can also be of a linear apex type defining more or less intricate linear design patterns.

The second projections can also be combinations of dotted apexes and linear apexes on the same ply, on the two plies or respectively on the one and on the other of the two plies.

When the second projections are tapered, they are preferably micro-projections in comparison with the first tapered projections with a density of micro-projections of between 30 and 80 projections per $cm^2$.

The diameter of the apexes of the picots in order to engrave the micro-projections is, for example, on the order of 0.4 mm while the former of the first (macro) projections is on the order of 1.0 mm.

By way of example, if the corresponding heights of the first picots 30 and of the second picots 46 formed by a relief on the cylinder 26, intended for the embossing of a first ply 12 of a sheet of paper are considered for use as a kitchen towel, the height of the first picots 30 is equal to 1.3 millimeter whereas the height of the second picots 46 is equal to 0.7 mm. With a cylinder thus defined, associated with a cylinder with appropriate rubber coating, a ply of cellulose cotton of 22 $g/m^2$ is embossed and an average thickness H of the first ply 12 on the order of 0.8 mm is obtained.

The first picots 30 and the second picots 46 are tapered with a circular, oval, polygonal, or other shape section and preferably at a steep incline of between 60° and 70°.

The apexes 42, 44 of the second projections 38, 40 of the first ply 12 and second ply 14 are extended out facing and near the opposite and more or less axially aligned apexes 44, 42 of the second projections 40, 38 of the other ply 14, 12.

Such an embossed sheet 10 presents a suppleness greater than that of an embossed sheet made in accordance with known techniques while not having the mechanical characteristics and absorptivity diminished.

Figure 3:
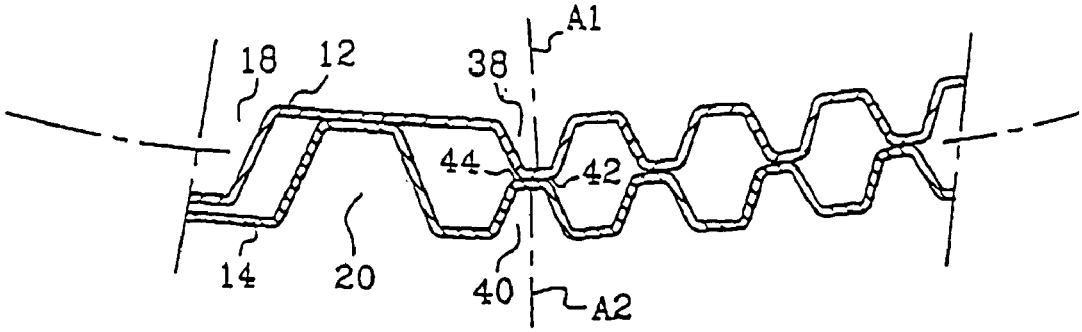
FIG. 3 is a diagrammatic sectional view of a sheet of embossed paper which is made in accordance with the teaching of the invention and which is slightly cambered.

The suppleness of the sheet 10 is improved because, during the cambering of the sheet 10, the apexes 42 and 44 of the second projections 38 and 40 can be slightly displaced one by the other, i.e., by being inclined and displaced as shown in FIG. 3.

The mutual support of the apexes 42 and 44 of the second projections 38 and 40 inhibit the formation of a folding line harmful to the suppleness of the sheet and favors the cambering of the sheet 10.

The mutual support of apexes 42 and 44 of the second projections 38 and 40 also permits the crushing of the sheet 10 to be minimized, which permits sheet 10 to conserve its bulk, i.e., its absorptivity.

In accordance with FIG. 2, the apexes 42 and 44 of the second projections 38 and 40 can be in contact. They are not connected among themselves.

Figure 4:
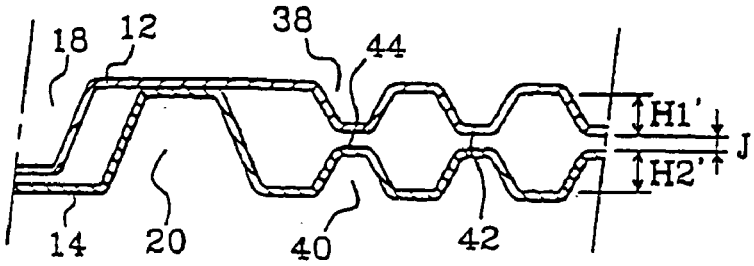
FIGS. 4 and 5 are diagrammatic sectional views of a sheet of embossed paper made in accordance with variants of the embodiment of the invention.

According to a variant shown here in FIG. 4, the apexes 42 and 44 of the second projections 38 and 40 are separated axially by a slight gap indicated by the letter J.

FIGS. 2 and 4 show the second projections 38 and 40 which are symmetrical relative to the median plane of the sheet 10, i.e., their heights H1, H2 are all as equal as the heights H1', H2'

Figure 5:
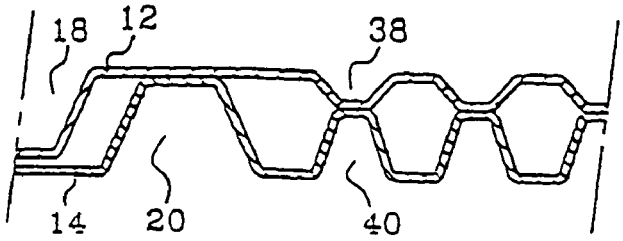

However, according to a variant shown in FIG. 5, the second projections 38 and 40 can be dissymmetrical.

Without departing from the scope of the invention, it is not necessary that the apexes of the facing second projections be perfectly aligned.

Nor is it required that there be an integral correspondence of the two projections of a ply with the second projections of the other ply.

As regards the performance of a sheet claimed for the invention, they are analogous to those of a corresponding product as known in the art with solely the first projections, with the exception of the suppleness of the sheet which is greatly improved.

In fact, tests have shown that the stiffness of the sheet according to the invention, i.e., the opposite of suppleness (measured according to the Geometric Mean Stiffness method), is reduced by more than 20% relative to the stiffness of the sheet made in accordance with known techniques.

The invention claimed is:

1. An embossed sheet comprising at least a first ply and a second ply of creped tissue paper having a basis weight ranging from 12 to 30 $g/m^2$, and said first ply and said second ply each comprising at least two embossed design patterns; wherein at least the first ply has a first embossed design pattern comprising a first series of first projections tapered and extending above an internal surface of the first ply, said first projections forming first alignments and having apexes in contact with an internal face of the second ply, and wherein the first ply and the second ply each have a second embossed design pattern comprising a second series of second projections extending above the internal surface of a corresponding ply, and having apexes of the second projections of one of said first ply or said second ply extend over and face and be near apexes of the second projections of the other ply;

wherein the apexes of the second projections of one ply are in contact with the apexes of the second projections facing the other ply; and wherein the second ply additionally has a first series of first projections and said first series of first projections of each of the first ply and the second ply are nested to each other.

2. The embossed sheet as claimed in claim 1, wherein the apexes in contact with the second projections are not connected.

3. The embossed sheet as claimed in claim 1, wherein heights of the second projections of the first ply and the second ply are substantially equal.

4. The embossed sheet as claimed in claim 1, wherein the first series of first projections of the first ply and the second ply form the first alignments.

5. The embossed sheet as claimed in claim 1, wherein the first projections form figures of a closed loop design.

6. The embossed sheet as claimed in claim 1, wherein the second projections have dotted apexes.

7. The embossed sheet as claimed in claim 1, wherein the second projections have linear apexes.

* * * * *